United States Patent [19]

McEntire

[11] Patent Number: 4,606,510

[45] Date of Patent: Aug. 19, 1986

[54] PAPER TOWEL HOLDER SUPPORT

[76] Inventor: W. L. McEntire, 420-B Glenhill Cir., Chattanooga, Tenn. 37415

[21] Appl. No.: 740,891

[22] Filed: Jun. 3, 1985

[51] Int. Cl.[4] ..... B65H 19/10; B65H 16/02

[52] U.S. Cl. ..... 242/55.3

[58] Field of Search ..... 242/55.2, 55.3, 55.53; 312/37, 38, 39, 40, 41

[56] References Cited

U.S. PATENT DOCUMENTS

| | | | |
|---|---|---|---|
| 3,101,181 | 8/1963 | Clelland et al. | 242/55.3 |
| 3,381,909 | 5/1968 | Tucker et al. | 242/55.3 |
| 3,698,653 | 10/1972 | Okamura | 242/55.3 |
| 3,870,211 | 3/1975 | Schriever | 242/55.3 X |
| 3,948,454 | 4/1976 | Bastian | 312/39 X |

*Primary Examiner*—Donald Watkins
*Attorney, Agent, or Firm*—Alan Ruderman

[57] ABSTRACT

A dual roll paper towel dispensing support has a moveable platform supporting a pair of paper towel holders for carrying the rolls of towel with the axes of the rolls parallel in spaced relationship. The plate has an elongated slot disposed parallel to the axes of the rolls and spaced intermediate the roll axes. A journal member is disposed within the slot and supports the platform from a fixed member. A compound rotary and sliding movement of the platform may be performed to permit the initially disposed rear roll to be repositioned to the front when the front roll is empty.

5 Claims, 5 Drawing Figures

PAPER TOWEL HOLDER SUPPORT

BACKGROUND OF THE INVENTION

This invention relates to a paper towel holder support and more particularly to a paper towel holder support for mounting a pair of paper towel rolls under the ledge of a conventional kitchen cabinet for selective disposition of the rolls to the front for dispensing thereof.

Wide use is made of single roll paper towel holders mounted under the shelf of conventional kitchen cabinets, and although multiple roll tissue and paper towel dispensers are known in the prior art for various applications (see for example, U.S. Pat. Nos. 3,650,487; 3,677,485 and 3,754,719) such multiple roll dispensers and holders are not practicable for use under conventional kitchen cabinets. In the known dispensers the rolls are mounted in vertically superposed disposition with their axes spaced one above another. If such an arrangement were utilized in a home kitchen where the rolls are mounted on the cabinet above a sink or counter, the rolls would interfere with the servicability of the sink or counter and there would be an inefficient utilization of the available space. Moreover, it would also present an unappealing kitchen arrangement. Furthermore, although such rolls are of a diameter such that two rolls may be mounted with their axes in spaced vertical planes one behind the other below the cabinet, the length of the conventionally used rolls together with the holders is longer than the depth of the cabinet from the wall such that a simple turntable type construction would not function. Thus, although there is a need for having a reserve roll of paper towels conveniently available above a kitchen sink, no such proposal appears in the art.

SUMMARY OF THE INVENTION

Consequently, it is a primary object of the present invention to provide a support for mounting a pair of paper towel rolls beneath a kitchen cabinet for providing a reserve roll in a handy readily available position.

It is another object of the present invention to provide a support for mounting dual rolls of paper towels beneath a kitchen cabinet, the support being usable even where the cabinet has a depth narrower than the length of the rolls, the support further permitting the rolls to be mounted one behind the other and for selectively redisposing the rear roll to the front after the front roll is empty.

It is a further object of the present invention to provide a support for mounting a pair of paper towel roll holders in side-by-side relationship for supporting respective paper towel rolls with their axes substantially parallel, the support being mountable beneath a kitchen cabinet having a depth larger than the combined length of the rolls and the roll holders while permitting reversal of the positions of the roll holders so that after an initially frontwardly positioned roller is empty, the initial positions of the rolls may be readily reversed.

Accordingly, the present invention provides a dual roll paper towel dispenser support having moveable platform supporting a pair of paper towel holders for carrying the rolls of towel with the axes of the rolls parallel in spaced relationship, the platform having an elongated slot disposed substantially parallel to the axes of the rolls and spaced therebetween, and a journal member disposed within the slot and supporting the platform from a fixed member. With this construction a compound rotary and sliding movement of the platform is permitted as may be necessary when the rolls are too long to turn under the available cabinet space.

In the preferred form of the invention the platform is merely a plate having the roll holders fastened thereto in spaced relationship and the slot is formed intermediate the holders. A shoulder screw or the like having an elongated head is disposed within the slot with the head straddling the lateral margins of the slot permitting the plate to pivot and slide relative to the shoulder as a journal. The screw may be threaded directly into the underside of the cabinet but preferably it is fastened to another plate which is secured to the cabinet to ensure sufficient support for the assembly.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
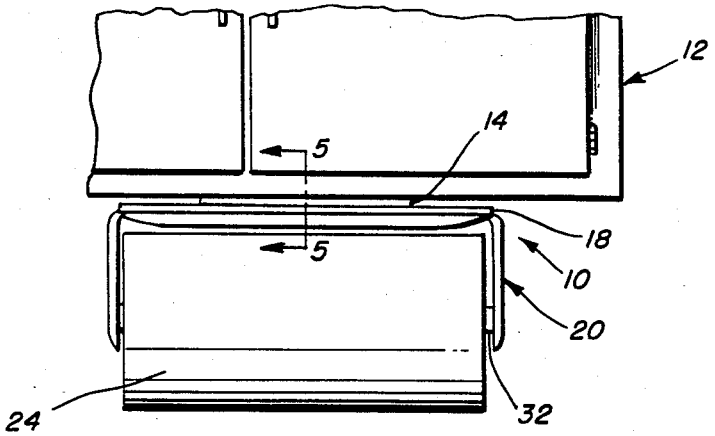
FIG. 1 is a front elevational view of a paper towel dispenser support constructed in accordance with the present invention mounted in the central operating position beneath a kitchen cabinet.

Referring now to the drawings the dual paper towel dispenser support 10 constructed in accordance with the present invention is disclosed as mounted beneath a kitchen cabinet 12 on a mounting plate 14 of any convenient configuration and material secured to the bottom surface 16 or ledge of the cabinet. The dispenser support 10 includes a support platform 18 onto which a pair of paper towel roll holders 20, 22 are mounted by means of screws 23 or the like in spaced relationship, the holders being conventional as illustrated in U.S. Pat. No. 3,116,030. The spacing between the holders is such that a pair of full rolls of paper towels 24, 26 may be mounted without interference with each other so that the towels may be dispensed easily in the normal fashion, each roll 24, 26 being carried on a respective core 28, 30 rotatable about the roll mounting cylindrical hubs 32 of the holders 20, 22, the axes of the cores 28, 30 and thus the rolls 24, 26 being substantially parallel to one another. The platform 18 comprises a thin plate sized for supporting the holders, the plate preferably being formed from wood, but may be of any other material such as plastic.

Figure 4:
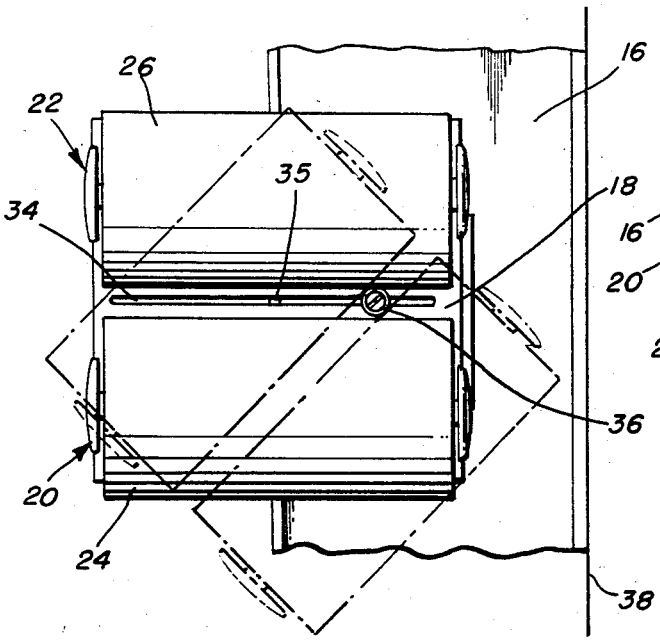
FIG. 4 is a bottom plan view illustrating the support dispenser in the position illustrated in FIG. 3 in the solid lines, and showing a position intermediate the positions illustrated in FIGS. 2 and 3 in phantom.
Figure 5:
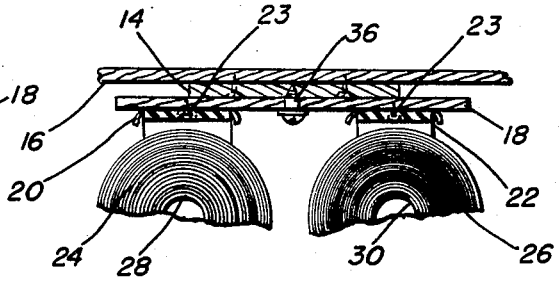
FIG. 5 is a cross sectional view taken substantially along line 5—5 of FIG. 1.

Formed in the platform 18 spaced intermediate the holders 20, 22 and extending longitudinally in a direction substantially parallel to the axes of the cores 28 and 30 is a narrow slot 34, best illustrated in FIG. 4, for receiving a journal member 36 in the form of a screw which threadedly is received within the plate 14. The head of the screw 36 is larger than the width of the slot 34 so that the head may support and carry the platform when the screw is secured to the plate 14. The slot 34 extends entirely through the platform and is of a length sufficient for permitting the platform to be slid relatively to the screw 36 an amount sufficient so that the rear roll 26 may clear the rear wall 38 under the cabinet when rotated as illustrated in FIG. 4. Although not shown the slot 34 preferably would extend from the center of the platform 18 such as at 35 so that the platform can be quickly centered in the use position of the rolls. The screw 36 may have a shoulder preferably of a length at least substantially equal to the thickness of the platform 18 so as to act as a journal for both sliding and rotational movement of the platform relative thereto.

Figure 2:
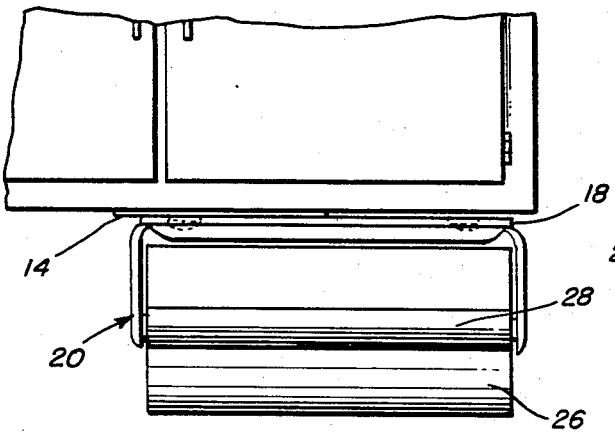
FIG. 2 is view similar to FIG. 1 with the dispenser support in a longitudinally shifted position during a step in the reversal of the holder location.
Figure 3:
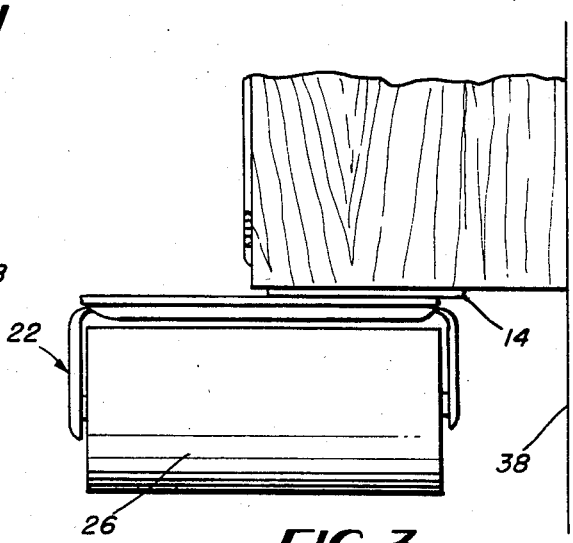
FIG. 3 is a side elevational view illustrating the position of the elements when the position of the support dispenser is turned 90° to the positions illustrated in FIGS. 1 and 2.

In operation, the platform 18 is extended endwise by pulling it in the longitudinal direction of the slot 34 as illustrated in FIG. 2, and by either simultaneously rotating the platform as it is slid or rotating it subsequent to such sliding. The platform can thus be positioned so that the rear roll 26 will clear the well 38 as illustrated in FIGS. 3 and 4. The holders may be loaded with full rolls and rotated to the original position illustrated in FIG. 1. When dispensing of the towels on the front roll 24 is complete and the roll is empty the platform may then be extended axially of the slot 34 as aforesaid and rotated 180° about the journal member 36 to position the full rear roll 26 in the front position for dispensing of towels therefrom. In this manner, although the rolls 24, 26 together with the holders 20, 22 may be longer than the depth of the cabinet 12, the rolls may be rotated about the journal 36, thereby readily presenting a full roll when the front roll is empty.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A paper towel roll dispenser support for mounting a pair of rolls of paper towels from a ledge beneath a wall mounted cabinet with the rolls in spaced front to back relationship, said dispenser support comprising a platform, first and second paper towel roll holders fastened to said platform in spaced relationship, each of said holders having a pair of roll mounting cylindrical hubs for carrying a roll of towels therebetween, the holders being disposed such that the axes of the hubs of the first holder is spaced from and substantially parallel to the axes of the hubs of the second holder, means defining an elongated slot in said platform intermediate said holders and extending in a direction substantially parallel to the axes of the hubs of said holders, a journal member disposed through said slot, said journal member having an abutment means on one end thereof larger than the width of said slot for precluding withdrawal of said one end through said slot, and means for securing the journal member to said ledge thereby permitting said platform to slide relative to said journal member in the direction of said slot and to rotate about said journal member.

2. A paper towel dispenser roll as recited in claim 1, wherein said journal member comprises a shoulder screw and said abutment member comprises an enlarged head at said one end.

3. A paper towel roll dispenser support as recited in claim 2, wherein said platform comprises a plate having a thickness substantially equal to the length of the shoulder of said screw.

4. A paper towel roll dispenser support as recited in claim 3, wherein said means for securing the journal member to said ledge comprises a mounting plate fastened to said ledge, said screw being received within said mounting plate.

5. A paper towel roll dispenser as recited in claim 3, wherein said slot extends from substantially a central portion of said platform toward an end of said plate.

* * * * *